US008894239B2

(12) United States Patent
Wendt et al.

(10) Patent No.: US 8,894,239 B2
(45) Date of Patent: Nov. 25, 2014

(54) LIGHTING UNIT

(75) Inventors: Matthias Wendt, Würselen (DE); Maimé Indigo Melanie Ruh, Erftstadt (DE)

(73) Assignee: Koninkijke Philips N.V., Eindhoven (NL)

( * ) Notice: Subject to any disclaimer, the term of this patent is extended or adjusted under 35 U.S.C. 154(b) by 0 days.

(21) Appl. No.: 13/266,785

(22) PCT Filed: Apr. 26, 2010

(86) PCT No.: PCT/IB2010/051816

§ 371 (c)(1), (2), (4) Date: Oct. 28, 2011

(87) PCT Pub. No.: WO2010/125513

PCT Pub. Date: Nov. 4, 2010

(65) Prior Publication Data

US 2012/0057347 A1 Mar. 8, 2012

(30) Foreign Application Priority Data

Apr. 28, 2009 (EP) ..... 09158927

(51) Int. Cl.

| | |
|---|---|
| ***F21V 19/02*** | (2006.01) |
| ***F21V 14/02*** | (2006.01) |
| *F21Y 101/02* | (2006.01) |
| *F21W 131/402* | (2006.01) |

(52) U.S. Cl.

CPC ..... *F21V 19/02* (2013.01); *F21Y 2101/02* (2013.01); *F21V 14/02* (2013.01); *F21W 2131/402* (2013.01)

USPC ..... 362/249.03; 362/249.04

(58) Field of Classification Search

USPC ..... 362/249.01–249.04, 267, 101, 362/281–283, 147, 404

See application file for complete search history.

(56) References Cited

U.S. PATENT DOCUMENTS

2003/0193802 A1 10/2003 Luk
2005/0117339 A1* 6/2005 Pan ..... 362/249

(Continued)

FOREIGN PATENT DOCUMENTS

CN 101377273 A 3/2009
DE 102007002838 A1 3/2008

(Continued)

OTHER PUBLICATIONS

Rice, James R. "The Localization of Plastic Deformation." Theoretical and Applied Mechanics 1 (1976): 207-20. Print.*

(Continued)

*Primary Examiner* — Diane Lee
*Assistant Examiner* — Gerald J Sufleta, II
(74) *Attorney, Agent, or Firm* — Meenakshy Chakravorty

(57) ABSTRACT

The invention provides a lighting unit comprising a substantially continuous, pliable surface (10) and a plurality of light sources. The light sources (20) are arranged to generate light beams (24) with respective optical axes (O). Each of the light sources (20) is connected to the pliable surface (10) at respective surface areas (30) of the pliable surface (10), whereby orientations of the respective surface areas (20) and orientations of the respective optical axes (O) are linked. The pliable surface (10) has a profile (Z) that is pliable into different profiles with corresponding different orientations of at least part of the plurality of surface areas (30). The lighting unit can thus easily provide different illumination profiles. In this way, a flexible lighting unit is provided, as the profile of the pliable surface can be defined and, after having been initially defined, also changed in dependence on e.g. user needs.

16 Claims, 7 Drawing Sheets

(56) References Cited

U.S. PATENT DOCUMENTS

| | | | | |
|---|---|---|---|---|
| 2006/0092657 | A1 | 5/2006 | Naniwa et al. | |
| 2006/0221608 | A1 | 10/2006 | Ishizuka et al. | |
| 2008/0225523 | A1* | 9/2008 | De Samber et al. | 362/249 |
| 2010/0038660 | A1* | 2/2010 | Shuja | 257/98 |
| 2010/0148704 | A1* | 6/2010 | Howng et al. | 315/313 |

FOREIGN PATENT DOCUMENTS

| | | | |
|---|---|---|---|
| JP | 61104914 | U | 7/1986 |
| JP | 200010083 | A | 1/2000 |
| JP | 2003229014 | A | 8/2003 |
| JP | 2003308721 | A | 10/2003 |
| JP | 2005228566 | A | 8/2005 |
| JP | 2006059663 | A | 3/2006 |
| JP | 2006127963 | A | 5/2006 |
| WO | 02097917 | A1 | 12/2002 |
| WO | 2008069582 | A1 | 6/2008 |

OTHER PUBLICATIONS

Rees, D. W. A. "Chapter 1." Basic Engineering Plasticity: An Introduction with Engineering and Manufacturing Applications. Boston, MA: Elsevier, 2006. N. pag. Print.*

* cited by examiner

LIGHTING UNIT

FIELD OF THE INVENTION

The invention relates to a lighting unit, a lighting system with such lighting unit(s), and a space with such lighting unit(s) and a use of such lighting unit(s).

BACKGROUND OF THE INVENTION

Lighting in offices is usually provided as a combination of different types of lighting systems. For example, fluorescent lighting is installed in a ceiling as general illumination of the office, desktop lamps are used for providing individual task lighting for individuals working on a desk, and halogen spots are positioned on the ceiling or on the wall for providing spot lighting for pictures hanging on the wall. In this way, light is provided with both functional and decorative purposes. Most types of lighting systems are one-time installed, fixed installations. Some individual, standalone lamps may be adjustable, such as the desktop lamp.

An example of such a standalone adjustable lamp is described in US patent application US 2003/0193802 A1. US 2003/0193802 A1 describes a diode light source system for stage, theatre and architectural lighting including a plurality of separate flat panels for mounting a plurality of light emitting diodes emitting a plurality of diode light beams to a common focus area. A housing containing the panels has a center base portion and a circular rim defining a housing aperture aligned with a circular rim plane having a rim plane center arranged transverse to an axis aligned with the center base portion. A screw arrangement positions the panels at a plurality of selected positions where each panel is oriented at a selected angle relative to the axis and the grouped diodes emit diode light beams transverse to each separate panel.

SUMMARY OF THE INVENTION

A disadvantage of many of the prior art systems may be for instance that the prior art lamps only generate a single beam, and moreover offer a limited degree of flexibility as they only allow varying a degree of convergence in the single beam in a pre-determined focus direction. Therefore, such lamps are in general useless for office lighting, let alone office lighting suitable for providing a combination of different types of light such as for instance general lighting and task lighting.

Another disadvantage of many of the prior art systems may be for instance that the illumination of the office is largely fixed by the available lighting installation, causing the positions of work spaces, e.g. office desks, in an office to be determined by said available lighting installation, rather than being determined for an effective use of office space area. Furthermore, users may not want to have to use additional light sources for task lighting, such as a desktop lamp which takes up desktop space. Another disadvantage of the prior art may be that the lighting pattern cannot (easily) be changed after the system has been installed.

There is a desire for flexibility in the arrangement of the lighting in a room, especially on a ceiling, and particularly in a space with distributed working areas such as an office, or in a space with a frequently changing layout, such as a shop. It is a further desire to provide a versatile lighting arrangement, requiring a one-time installation while at the same time allowing illumination to be provided having different degrees of light concentration, e.g. general illumination of a room and areas with concentrations of light for task lighting in working areas, or concentrations of light of specific colors in displays of articles in shops with general illumination throughout the rest of the shop floor. It may be a further desire to additionally allow playful light distributions to be provided in specific areas, e.g. unused areas, of the space.

Hence, it is an aspect of the invention to provide an alternative lighting unit (or lighting system), which preferably further at least partly obviates one or more of the above-described drawbacks, and which further preferably fulfils one or more of the above indicated desires.

To achieve this, the invention provides, in a first aspect, a lighting unit comprising a substantially continuous, pliable surface and a plurality of light sources, wherein each of the light sources is arranged to generate a light beam with a respective optical axis, each of the light sources is connected to the pliable surface at a respective surface area of the pliable surface, whereby orientations of the respective surface areas and orientations of the respective optical axes are linked; and the pliable surface is pliable into different profiles with corresponding different orientations of at least part of the plurality of surface areas.

Hence, the profile of the pliable surface may define the orientations of the surface areas of the pliable surface, and the orientations of the optical axes may be defined correspondingly, as these are linked to the orientations of the respective surface areas. The lighting unit can thus easily provide different illumination profiles. In this way, a flexible lighting unit is provided, as the profile of the pliable surface can be defined and, after having been initially defined, also changed in dependence on e.g. user needs. When e.g. the lighting system is installed in an office having for instance working areas with desks and open areas and corridors between the desks, a part of the pliable surface may e.g. be shaped to provide concentrated light to the working areas for obtaining an optimal light distribution at the desks, while the rest of the pliable surface may be shaped to provide general illumination, e.g. as a background illumination level in the office and as illumination of the open areas and corridors. When the position of the desks in the office changes, the pliable surface may be shaped differently to accommodate for the changed positions.

A further advantage may be that while the lighting unit may be perceived as one light, some areas in a space nevertheless may be more strongly illuminated than other areas (illumination profile). Hence, the lighting unit may be arranged to provide an extended but substantially homogeneous illumination device (for instance as ceiling light), which surprisingly illuminates some parts more strongly than others.

A further advantage may be that no further light sources for task lighting are needed in addition to the light sources for general lighting, as the lighting unit according to the invention may provide both types of lighting with the same light sources. The lighting unit according to the invention may efficiently accommodate both types of lighting in terms of amount of light installed and total amount of power that is installed.

The term "lighting unit" may also refer to a plurality of lighting units. A lighting system may be composed comprising a plurality of such lighting units. Hence, a lighting system may comprise one or more lighting units, preferably a plurality of lighting units, such as 2-96.

The lighting unit may in particular be an illumination device. The lighting unit may be attachable to a ceiling of a space, e.g. an office space or a shop space, for providing illumination to the room as a ceiling light. The lighting unit may be directly attachable to a ceiling and/or suspendable from a ceiling. The lighting unit may be connectable to one or more other lighting units for forming a larger-sized lighting unit and/or for forming a lighting system.

The pliable surface may correspond to one of the sides of a pliable sheet. The light sources may be provided on the pliable surface, inside the surface or behind the surface, which in the latter case is at least locally transparent to the generated light beam. Locally transparent may herein refer to an opening in the surface to allow light from the light source to escape from behind the surface but may also refer to a transparent material, like a transparent plastic. The term "substantially continuous" may for instance indicate that the pliable surface may be perceived by a user as an integral and continuous surface, without sharp discontinuities or openings, except for embodiments with optional openings to allow light from the light sources to escape from the lighting unit, and except for the light sources and optional optics.

Thus, the light sources are connected to the pliable surface. In this way, the orientation of the surface area, i.e. local parts of the pliable surface to which the light sources are connected is linked to the orientation of the optical axes. When the surface area to which the light source is connected is moved by pressing, pushing, bending, pulling, etc. also the light source may move and thus the optical axis may move. Likewise, since the light sources are connected to the pliable surface, moving a light source may also cause the surface area to move locally. Thus, when changing the orientation of the optical axis, also the orientation of the surface area may change. Moreover, when moving a surface area to which one light source is connected, also the optical axes of its neighboring light sources may experience gradual changes, the gradual change depending on the distance from the location where the surface was moved, thus yielding a smooth illumination profile. In one way or another, the light sources may thus be attached to the respective surface areas. Such attachment may thus be on, within, or behind the surface area.

Embodiments are described below. As will be clear to the person skilled in the art, embodiments may be combined.

In an embodiment, the lighting unit comprises a closed body comprising the pliable surface. The closed body may e.g. be a rigid drum covered with a membrane of a pliable material, the outer surface of the membrane forming the pliable surface. The closed body may thus contact at one or more positions the pliable surface, either directly or indirectly via intermediate parts, or at least part of the closed body may contain at least part of the pliable surface.

In an embodiment, the closed body is arranged to control the profile, using pressure of a fluid, in particular a gas or a liquid, preferably a gas. The term fluid may also refer to a mixture of fluids. E.g., when the pressure inside the closed body and outside the closed body is the same, the pliable surface may be substantially flat and the profile will be substantially flat. When the pressure inside the closed body is however larger than outside the closed body, the pliable surface may be pressed outward by the larger inside pressure and acquire a convex shape. On the other hand, when the pressure inside the closed body is smaller than outside the closed body, the pliable surface may be pressed inward by the larger outside pressure and acquire a concave shape. The profile can thus be controlled into different degrees of convexity and concavity, in dependence on the pressure in the closed body, or the pressure difference between the inside and the outside of the closed body. The changing of the profile may be referred to as inflating and deflating, or more generally as ballooning in the following. Herein, the term "closed body" may thus refer to a body having an internal volume that can be filled with a fluid, and thus having one or more openings to introduce and/or remove (or allow to escape) the fluid.

In a further embodiment, the pressure is provided as a gas pressure or a liquid pressure. Thus, the fluid may be a gas or a liquid, preferably a gas. The gas may e.g. be air. The use of air is advantageous as it provides a lightweight structure, and an air pressure can be controlled relatively easily. A liquid, e.g. water, may be advantageous e.g. when the liquid can be circulated through the closed body for transporting heat away from heat sources, e.g. the light sources.

In an embodiment, the closed body comprises a plurality of closed compartments, the closed body being arranged to control the profile of the pliable surface using individually controllable pressures for the closed compartments. This allows shaping each compartment individually according to an individual level of convexity or concavity, thus allowing more flexibility in the overall profile of the pliable surface. The individually controllable pressures may be supplied and controlled from outside the closed body, or provided by the closed body itself. The closed compartments may thus contact at one or more positions the pliable surface, either directly or indirectly via intermediate parts, or at least part of the closed compartments may contain parts of the pliable surface, respectively.

The compartments may be individual compartments, but one or more of the compartments may also be in communication with each other. Herein, the term "closed compartment" may thus refer to a compartment having an internal volume that can be filled with a fluid, and thus having one or more openings to introduce and/or remove (or allow to escape) the fluid.

The above described embodiments with the closed body and with the plurality of closed compartments are herein also indicated as "balloonable closed bodies".

In an embodiment, the lighting unit is arranged to transmit a flow of liquid or gas through the closed body. Transmitting a flow of liquid or gas may allow transporting the heat away from e.g. the light sources. Moreover, controlling the flow rate and the amount of liquid or gas in the closed body, and in its individual compartments, provided it comprises a plurality of compartments, allows applying and controlling the pressure(s), and thus controlling the profile. The flow of the fluid may circulate within the closed body, thus providing a self-contained system. Alternatively, the flow of liquid or gas may originate from an external source, supplying a fresh or recycled liquid or gas to the lighting unit, and is delivered to an external drain. The flow may have pressure control and/or flow control means.

In an embodiment, the lighting unit comprises an actuator arranged to actuate the pliable surface at a plurality of actuating positions. As mentioned above, the orientation of the optical axes and the respective surface areas are linked. Hence, in an embodiment, the lighting unit may also comprise an actuator arranged to actuate the optical axes of the light sources at actuating positions at the light sources.

The actuator can provide the pliable surface with the profile, by acting on the pliable surface at the plurality of actuating positions, and thus orienting the surface areas and hence the orientations of the light beams. The actuator may e.g. provide a mechanical actuation, for instance substantially perpendicular to a reference plane corresponding to the pliable surface in a flat shape. Likewise, the actuator can provide the plurality of light sources with an illumination profile, thereby actuating also the pliable surface.

The actuator typically comprises a plurality of actuator elements connected to the pliable surface and/or some of the light sources at the plurality of actuating positions. As mentioned above, orientations of the respective surface areas and orientations of the respective optical axes are linked. Hence, controlling an illumination profile and/or controlling the profile of the pliable surface may defacto also be linked. When changing the profile, also the orientation of the optical axes of one or more light source may change. Alternatively (or additionally), when changing the orientation of the optical axes of one or more light sources, also the orientation of the surface area(s) may change and thus also the profile may change.

The actuator may be used as an alternative to the balloonable closed body. The actuator may also be used together with a closed body, e.g. cooperate with the liquid or air pressures in the closed body compartments for providing additional degrees of freedom in defining the profile: additional profiles, e.g. deviating from the substantially convex and concave profiles that each compartment can provide when using pressure of a fluid in respective closed compartments.

The actuators may have actuating units that may (independently) e.g. be selected from the group consisting of an electrical linear motor, a motor with screw gearing, a pneumatic motor, a linear piezo actuator, and a turn actuator, and that may be arranged for actuating respective actuator elements.

The use of the actuator may allow a very precise positioning and thus a very accurate definition of the illumination profile. The actuator may provide pre-determined illumination profiles in a convenient manner without a lot of manual adjustments.

The lighting unit may further comprise a controller for controlling the profile of the pliable surface of the lighting unit. The controller may e.g. control the pressure(s) of the closed body or its compartments. The controller may be an actuator controller for controlling the profile of the pliable surface provided by the plurality of actuator elements. The actuator controller may e.g. be in electrical communication with the plurality of actuator units, the actuator controller being arranged for controlling the profile. A plurality of predetermined conditions may e.g. have been programmed in a memory of the controller, e.g. by an expert operator, and one of the pre-determined conditions may be selected e.g. by any user, e.g. an office employee, or may be selected by the actuator controller as a result of a sensor signal of a sensor, such as a (day)light sensor, thermal sensor, time sensor, etc. The controller may thus also be arranged to control the profile of the optical axes, or in other words, the controller may thus be arranged to control the illumination profile. By controlling the profile of the pliable surface of the lighting unit also the illumination profile may be controlled.

In a further embodiment, the number of actuating positions is different from the number of light sources. In particular, the number of actuating positions may be smaller than the number of light sources. This may be more economical as e.g. it allows the use of fewer actuating elements than the number of light sources. When a sufficiently large number of actuating positions is used, the pliable surface can still be shaped in a sufficiently smooth manner.

In an embodiment, the lighting unit is polygon-shaped. The use of polygon profiles may advantageously allow substantially seamless transitions between lighting units when two or more lighting units are combined, for instance in a lighting system. Polygon profiles may be selected and the lighting units may be arranged on a regular lattice. In an embodiment, a combination of two or more different types of polygons may be applied. In preferred embodiments, the regular lattice comprises either regular triangles, squares or hexagons.

In a further embodiment, the plurality of light sources are connected to the pliable surface in a substantially circular or spiraling arrangement, for instance centered around the center of the polygon-shaped lighting unit. In a yet further embodiment, the plurality of light sources is connected to the pliable surface of the polygon-shaped lighting unit in a substantially circular or spiraling arrangement, centered around the center of the polygon-shaped lighting unit. This may be advantageous when the pliable surface changes shape, as it may e.g. minimize stresses when the pliable surface expands, e.g. stresses induced in mounting, cooling or electrical connection means.

In an alternative further embodiment, the plurality of light sources is connected to the pliable surface in a substantially star-shaped arrangement, for instance, centered around the center of the polygon-shaped lighting unit. In yet another alternative embodiment, the plurality of light sources is connected to the pliable surface of the polygon-shaped lighting unit in a substantially star-shaped arrangement, centered around the center of the polygon-shaped lighting unit. This may be advantageous when the pliable surface changes shape, as it may e.g. minimize stresses when the pliable surface expands.

In an embodiment, the lighting unit comprises a pliable electrical connection interconnecting the plurality of light sources. The pliable electrical connection may be integrated with the pliable surface, which may be advantageous for thermal, electrical and/or mechanical reasons. For instance, copper wire may be used as material for establishing an electrical connection and as pliable material. An advantage of using such a pliable electrical connection, such as copper, may be that the pliable electrical connection may also have plastically deformable properties.

In an embodiment, the pliable surface is elastic. When the pliable surface is elastic, the pliable surface may advantageously return to a nominal condition with minimal internal forces, e.g. to a substantially flat shape. The lighting unit may thus be provided with a "default profile", for instance corresponding to a substantially uniform illumination profile. The nominal condition may correspond to a situation wherein (effectively) no forces are exercised on the pliable surface, e.g., when the air in the interior of the closed body is in open communication with the air outside the closed body and no pressure difference arises.

In an embodiment, the pliable surface is capable of maintaining its profile after being shaped, or in other words, the pliable surface is plastically deformable. This provides a semi-permanent profile to the pliable surface, and may thus e.g. be beneficial when the profile of the pliable surface is only seldom changed; while an initial defining and setting of a specific, typically non-flat profile is required, no continuous application of forces is required to maintain any initially defined shape. As will be clear to the person skilled in the art, the term "plastically deformable" indicates that the deformation is reversible and can be reversed by applying appropriate force(s).

In an embodiment the lighting unit comprises a sheet of pliable material comprising the pliable surface. The sheet of pliable material may e.g. be a membrane clamped in a frame. The membrane and the frame may together form a closed body, controlled with a pressure as described above. The pliable surface may alternatively be a sheet situated on and connected to an array of mechanical actuator elements, like a blanket on a bed of nails, wherein the array of actuator elements acts on the sheet as described above.

The light source may comprise any light source, such as a small incandescent lamp or a fiber tip or fiber irregularity (arranged to let light escape from the fiber, which embodiment has the advantage that it is relatively cheap), but may especially comprise a LED (light emitting diode). A specific advantage of using LEDs is that they are relatively small and lightweight and may therefore allow arrangement of a large number of light sources. Another specific advantage of using LEDs is that they may be equipped with properly designed optics and thus provide relatively narrow beams, allowing an accurate definition of the illumination profile generated by the lighting unit. The term LED may refer to organic LEDs (OLEDs), but especially refers to solid state lighting. Unless indicated otherwise, the term LED as used in the examples herein further refers to solid state LEDs.

In an embodiment, the light source preferably comprises at least one light-emitting diode (LED). Solid state LEDs as light source(s) are especially desired because of their small dimensions and capability of providing narrow beams. Preferably, the light sources are LEDs.

Further, in an embodiment, the pliable surface comprises a plurality of light sources, such as a plurality of LEDs, connected to the pliable surface. The term "plurality of light sources", such as a "plurality of LEDs", may refer to 2 or more light sources, especially 2-100,000 light sources, for instance 2-10,000, like 4-300, such as 16-256. In general, the lighting unit may comprise light sources such as LEDs at a density of 2-10,000 light sources/$m^2$ of pliable surface, especially 25-2,500 light sources/$m^2$, wherein the density is measured relative to a total area covered by the lighting unit (i.e. pliable surface). Preferably, the light sources, such as LEDs, are provided at a density of at least 1 LED per 100 $cm^2$ of pliable surface, preferably at a density of at least 1 LED per 10 $cm^2$. In a further embodiment, the LEDs are provided at a density of at least 1 LED per 5 $cm^2$.

With such a relatively high density, a large degree of flexibility is obtained. Moreover, a high density of LEDs allows the use of LEDs with a relatively low power dissipation, which may be advantageous from a thermal point of view. It will be appreciated that the number of LEDs used in the lighting unit may be determined in dependency on e.g. required light level(s), type and characteristics (such as light output level, color of light, thermal characteristics and/or electrical operating parameters) of the LEDs and required degree of flexibility in the illumination profile generated from the lighting unit.

In an embodiment, the light source(s) can be controlled for color and/or brightness. This may further improve the quality of the light. The color may e.g. be changed depending on the time of day, or on the type of work in the room. The color and/or brightness may be controlled by a controller in dependence on e.g. a sensor signal, a day and/or a time of day, or an input of a user. The input of the user may e.g. be provided from a remote control unit operated by the user, the remote control unit being arranged to provide control signals to the controller in dependence on the input of the user to the remote control unit. The input of the user may be provided as a selection from a pre-determined plurality of pre-determined settings, or as a freely programmable setting wherein the input of the user is e.g. compiled from a plurality of settings provided by the user for the light sources.

In a further embodiment, the light emitting diodes are provided with secondary optics. This allows providing narrow light beams, e.g. with an opening angle $\phi$ of 12° full-width-half-maximum (FWHM) or even 6° FWHM. In a further embodiment, the secondary optics are integrated with the pliable surface. This may provide a mechanically robust system.

In an embodiment, the lighting unit further comprises a monitor arranged to:

monitor a monitor parameter indicative of the profile of the pliable surface, the monitor parameter preferably being at least one of the group consisting of a pressure, a flow, a volume of the fluid, at least one orientation of at least one respective surface area and at least one orientation of at least one respective optical axis; and provide a monitor signal in dependence on the monitor parameter.

The monitor of the lighting unit thus provides a monitor signal allowing the control of the lighting unit to be observed and/or adjusted using e.g. an, internal or external, controller. The pressure can e.g. be the pressure inside the closed body, the pressures in its compartments, or the pressure applied in an external supply. The flow can e.g. be the rate of flow of liquid or gas through the closed body, or the flows through its compartments, or through one or more external supplies. The volume of the fluid can e.g. be the volume of the fluid present inside the closed body, or the respective volumes inside its compartments. A difference between the flow into the closed body (or a compartment), and the flow out of the closed body (or the compartment) may e.g. be used to determine a change of volume of fluid inside the closed body (or the compartment). The pressure and/or flow and/or volume provide indirect measures of the profile, but may be easy to obtain. The orientations may provide direct measures of the profile of the pliable surface and/or resulting directions of the light beams, and as such a direct measure of the resulting illumination profile. The skilled person will however know several methods and components for determining, e.g. measuring, orientations of surface areas and of beam directions or beam profiles.

In a further embodiment, the lighting unit is arranged to cooperate with a controller, the controller being arranged to:

receive the monitor signal from the monitor; and control the profile in dependence on the monitor signal, wherein the lighting unit preferably comprises the controller.

Especially, the lighting unit may comprise a controller arranged to control the profile of the lighting unit; i.e. the lighting unit may thus comprise a controller arranged to control the illumination profile of the lighting unit. The controller may be arranged external to the lighting unit, but is preferably integrated in the lighting unit.

The control can e.g. be a feedforward control, or alternatively a feedback control. Especially with a feedback control, design and manufacturing tolerances may be relaxed, as e.g. variations between degrees of convexity as a function of applied pressure between different closed bodies, as well as effects of atmospheric pressure, may be corrected using a feedback control.

A second aspect of the invention provides a lighting system comprising at least one lighting unit according to any one of the preceding claims. The lighting unit system thus easily provides different illumination profiles. In this way, a flexible lighting system is provided, as the profile of the pliable surfaces can be defined and, after having been initially defined, also changed in dependence on e.g. user needs. Further advantages of such a lighting system, and its further embodiments, will be apparent to the skilled person from the advantages of the lighting unit according to the invention as described above, and will not be repeated here. Preferably, an embodiment of the lighting system is provided comprising a plurality of lighting units, wherein the lighting units are polygonal shaped. In this way, a regular lattice of adjacent and optionally coupled, lighting units may be provided. In an embodiment the pliable surfaces of the at least one lighting unit together form a substantially continuous surface.

The term "lighting system" may also refer to a plurality of lighting systems.

In an embodiment, the lighting system comprises a system controller arranged to control the profile of the pliable surface of the at least one lighting unit.

A third aspect of the invention provides a space comprising a lighting system according to any one of the embodiments described above. The space may e.g. be a room, an office, a hallway, a corridor, a factory floor, or any other space in which an adjustment of lighting conditions without the need to re-install the lighting system in whole or in part may be expected. The space may in particular be a space with a plurality of working areas with individual lighting requirements. When such a space comprises a lighting system according to the invention, all working areas can be optimally illuminated without any re-installation being performed and without the need for additional lights, such as e.g. a desktop lamp. In further embodiments, the lighting system is arranged to illuminate a part of a wall of the space. This takes away the need for additional lighting units for perimeter wall lighting and may allow for a consistent illumination profile in the whole space. In an embodiment, the lighting system provides an illumination profile changing over a pre-determined time period from a first illumination profile to a second illumination profile. The changing may be repeated, providing a gradual cycling between two or more illumination profiles.

In an embodiment, the lighting system is attached to a ceiling of the space. The lighting system may be directly attached to the ceiling, or alternatively suspended from the ceiling. The lighting system can thus provide general illumination and concentrated illumination with a single system.

A fourth aspect of the invention provides a method of providing an illumination profile using a lighting system according to any one of the embodiments described above, the method comprising changing the profile of the pliable surface from a first shape into a second shape.

The method provides a convenient manner of changing the illumination profile.

In a further embodiment, providing the illumination profile is associated with providing a concentration of light generated by the light sources on part of the pliable surface. The concentration may e.g. be associated with a working area, or a display of an article in a shop.

In an embodiment, providing the illumination profile is associated with providing a plurality of concentrations of light generated by the light sources on respective parts of the pliable surface. The concentration may e.g. be associated with a plurality of working areas. The working areas may e.g. correspond to office desks in an office, work benches in a workshop, or individual working areas on a factory floor, or—analogously—to a plurality of displays of articles in a shop. Defining the illumination profile may be further associated with providing general illumination light. Providing the illumination profile may be associated with de-concentrating light generated by the light sources on part of the pliable surface. This allows providing diffusely illuminated areas, e.g. corresponding to a corridor or an open area in e.g. an office, workshop or factory floor. Providing the illumination profile may be associated with slowly changing the illumination profile over a predetermined time period from a first illumination profile to a second illumination profile.

In an embodiment, the changing of the profile comprises applying a pressure. For example, when changing the pressure levels in respective closed compartments of the lighting units of a lighting system according to an embodiment, the corresponding part of the profile changes its degree of convexity or concavity accordingly.

A fifth aspect of the invention relates to the use of a lighting system according to any one of the embodiments described above, for defining an illumination profile in a space.

The space may thus be provided with, e.g., one or more parts of the space where light generated by the light sources on part of the pliable surface is concentrated, preferably with a plurality of parts with concentrated light. The one or more parts of the space with concentrated light may thus be provided e.g. at different positions between different moments of use of the lighting system. The space may thus be provided with, e.g., one or more areas in the space where light generated by the light sources on part of the pliable surface is de-concentrated, thus providing diffusely illuminated areas in the space. The one or more parts of the space with concentrated light may be associated with e.g. working areas in the space. In an embodiment, the lighting system further provides light directed to a wall of the space, for generating perimeter lighting without the need for installing additional light sources for illuminating the wall. Illuminating the wall with the same lighting system as used for general lighting and task lighting may be advantageous in defining a consistent illumination profile across the whole space.

Throughout this document, the terms "blue light" or "blue emission" especially relate to light having a wavelength in the range of about 410-490 nm. The term "green light" especially relates to light having a wavelength in the range of about 500-570 nm. The term "red light" especially relates to light having a wavelength in the range of about 590-650 nm. The term "yellow light" especially relates to light having a wavelength in the range of about 560-590 nm. The term "light" herein especially relates to visible light, i.e. light having a wavelength selected from the range of about 380-780 nm. Light emanating from the carpet, i.e. from the carpet tile top face, into a space over the carpet is herein also indicated as "carpet light".

Unless indicated otherwise, and where applicable and technically feasible, the phrase "selected from the group consisting" of a number of elements may also refer to a combination of two or more of the enumerated elements.

Terms like "below", "above", "top", and "bottom" relate to positions or arrangements of items which will be obtained when the lighting system is arranged substantially flat on a substantially horizontal surface, with the lighting system bottom face substantially parallel to the substantially horizontal surface and facing away from the ceiling and into the room. However, this does not exclude the use of the lighting system in other arrangements, such as against a wall, or in other (vertical) arrangements.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION

Figure 1:
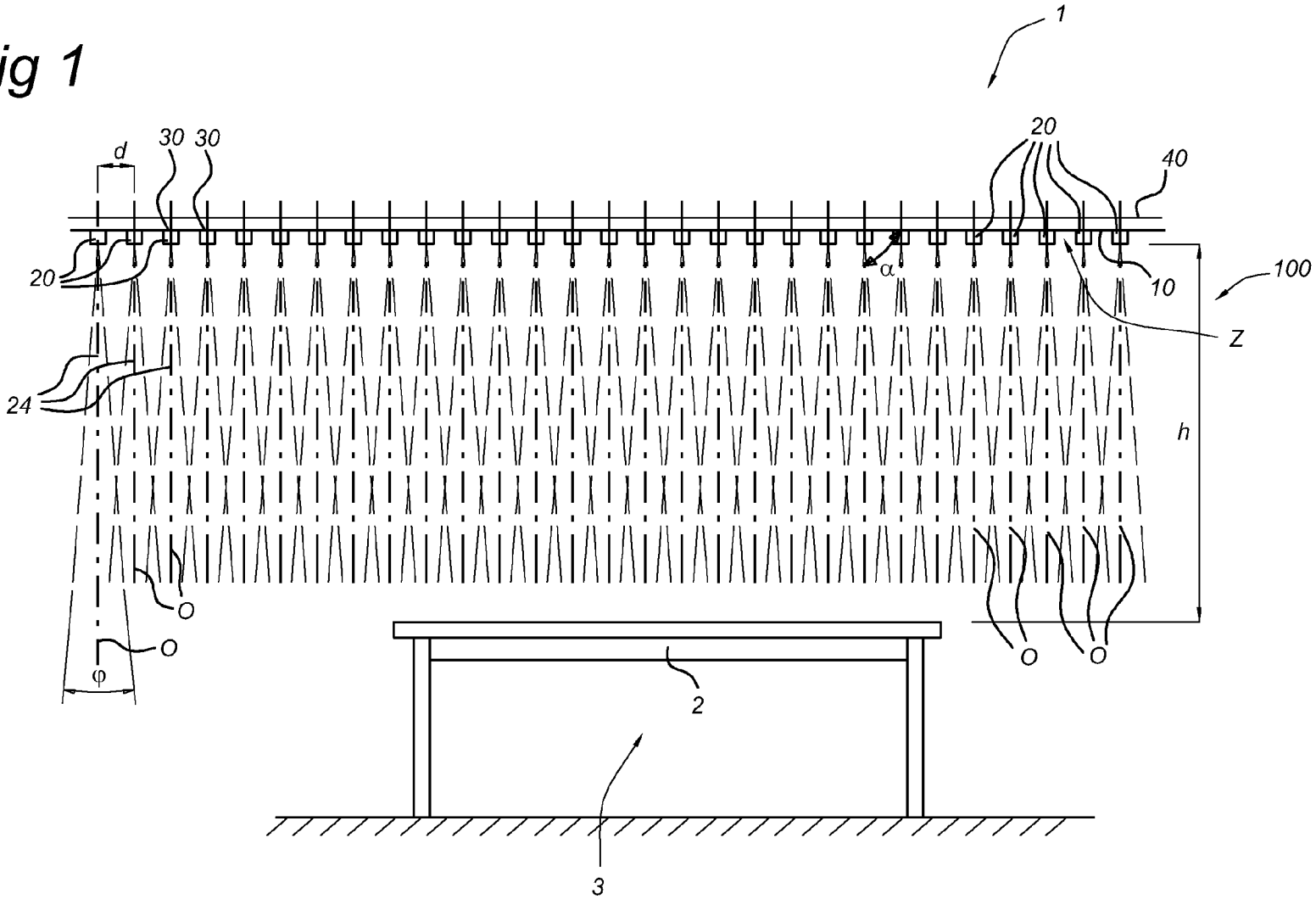
FIG. 1 and FIG. 2 schematically depict an embodiment of a lighting unit according to the invention.
Figure 2:
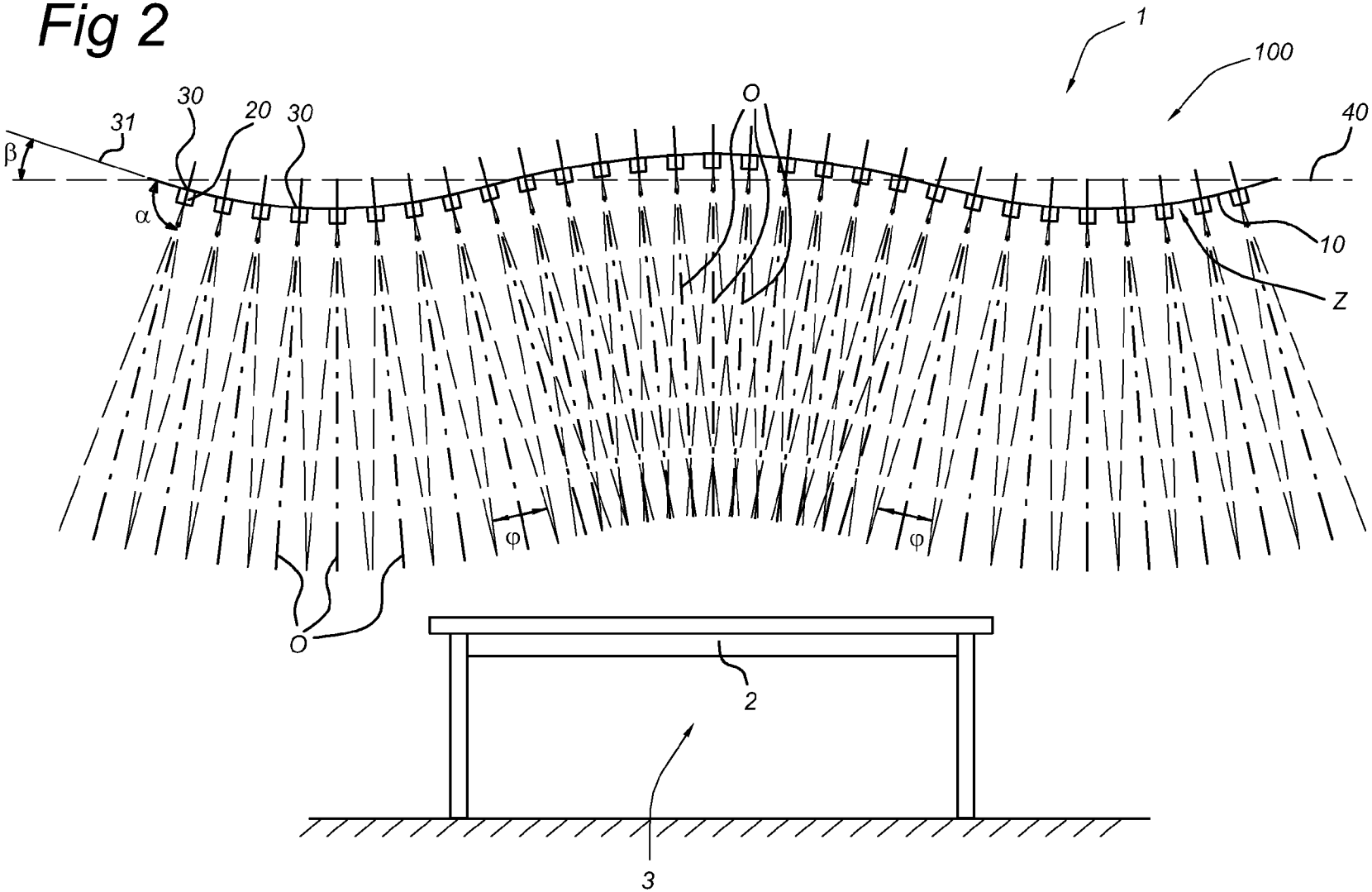

FIG. 1 and FIG. 2 schematically show an exemplary lighting arrangement 1, comprising a lighting unit 100. The lighting unit 100 has a surface 10. The surface 10 is a substantially continuous and pliable surface 10. The pliable surface 10 carries a plurality of light sources 20 at respective surface areas 30 of the pliable surface 10. Each of the light sources 20 is arranged to generate a light beam 24. The light beams 24 have respective optical axes O. In the example shown, each light beam 24 has an opening angle $\phi$, which preferably has a full-width-half-max (FWHM) value smaller than 20°, e.g. 6°. The light sources 20 are arranged on the pliable surface 10 in a pattern, e.g. on a grid with a distance d between neighboring light sources 20. The lighting unit 100 is arranged to illuminate a work space 3, indicated by means of a desk 2 in FIG. 1, and a surrounding area. The lighting unit 100 is e.g. attached to a ceiling of an office space. The lighting unit 100 is e.g. positioned at a height h above the desk 2. Alternatively, the height h may be measured as the distance of the lighting unit above the floor.

The pliable surface 10 has a profile Z that is pliable into different profiles. In FIG. 1, the profile of the pliable surface is a substantially flat profile, i.e. the pliable surface is substantially parallel to a, flat, reference surface 40. This situation may be referred to as a reference condition. In the reference condition in this example, all light sources 20 together provide a substantially uniform illumination pattern, which may e.g. be suitable for general illumination of a room.

The profile Z may be set according to a pre-determined shape and/or may be changed from a first shape to a second shape. Setting the profile Z to a pre-determined shape may comprise setting orientations of the surface areas 30 according to pre-determined orientations. Changing the profile Z from a first shape to a second shape may comprise changing orientations of the surface areas 30 from a plurality of respective first orientations to a plurality of respective second orientations, wherein at least one second orientation of a surface area 30 is different from the first orientation of the surface area 30. Orientations of the respective optical axes O of the light beams 24 are linked to the orientation of respective surface areas 30. Thus, different profiles of profile Z of the pliable surface 10 correspond to different orientations of at least part of the plurality of surface areas 30, and hence to different orientations of the corresponding optical axes O. It will be appreciated that, instead of setting or changing the profile Z of the pliable surface 10 resulting in a change of the orientation of at least part of the optical axes O, one may alternatively set or change the orientation of optical axes O by setting or changing the orientation of the light sources 20, resulting in a change of the profile Z of the pliable surface 10.

The light sources 20 are preferably distributed evenly on the pliable surface 10. The light sources 20 are preferably light emitting diodes (LEDs), as LEDs are lightweight and small, and provide well concentrated light beams, especially when provided with suitably designed secondary optics, e.g. with an opening angle $\phi$ of 6° FWHM. LEDs are also advantageous as they are available in multiple shades of white, as well as in multiple colors. The lighting unit 100 can thus be designed according to any requirements as to the color of the generated light, and/or the plurality of colors that can be provided from the lighting unit 100.

FIG. 2 shows the same lighting unit as in FIG. 1, with the pliable surface 10 with a profile Z having a different shape than in FIG. 1. In FIG. 2, the surface areas 30 of the pliable surface 10 are each oriented at individually controlled orientations. This is indicated in FIG. 2 for the left-most surface area 30: the surface area 30 makes an angle $\beta$ with the reference surface 40, angle $\beta$ being drawn as the angle between a tangent 31 of surface area 30 and reference surface 40. As a result, the orientation of light beam 24 generated by the corresponding light source 20 is changed. In the example shown, the orientation of the light beam 24 (i.e. especially its optical axis O) relative to the surface area 30 is shown as angle $\alpha$, which is approximately 90° in this example, i.e. the light beam 24 is oriented perpendicularly to the surface area 30. Thus, the light beam 24 is provided at an angle corresponding to p, relative to the normal of reference surface 40. Thus, in an embodiment, the orientation of the light beam 24 relative to the surface area 30 shown as angle $\alpha$ is substantially constant, since the orientation of the light source 20 and the orientation of the surface area 30 are substantially linked.

FIG. 1 and FIG. 2 clearly show that the profile Z of the pliable surface 10 of the lighting unit 100 can be set, or adjusted, so as to provide concentrations of light, e.g. for task lighting in working areas or for attention lighting directed at articles displayed in a shop, de-concentrations of light and substantially homogeneous light e.g. for general illumination.

Figure 3:
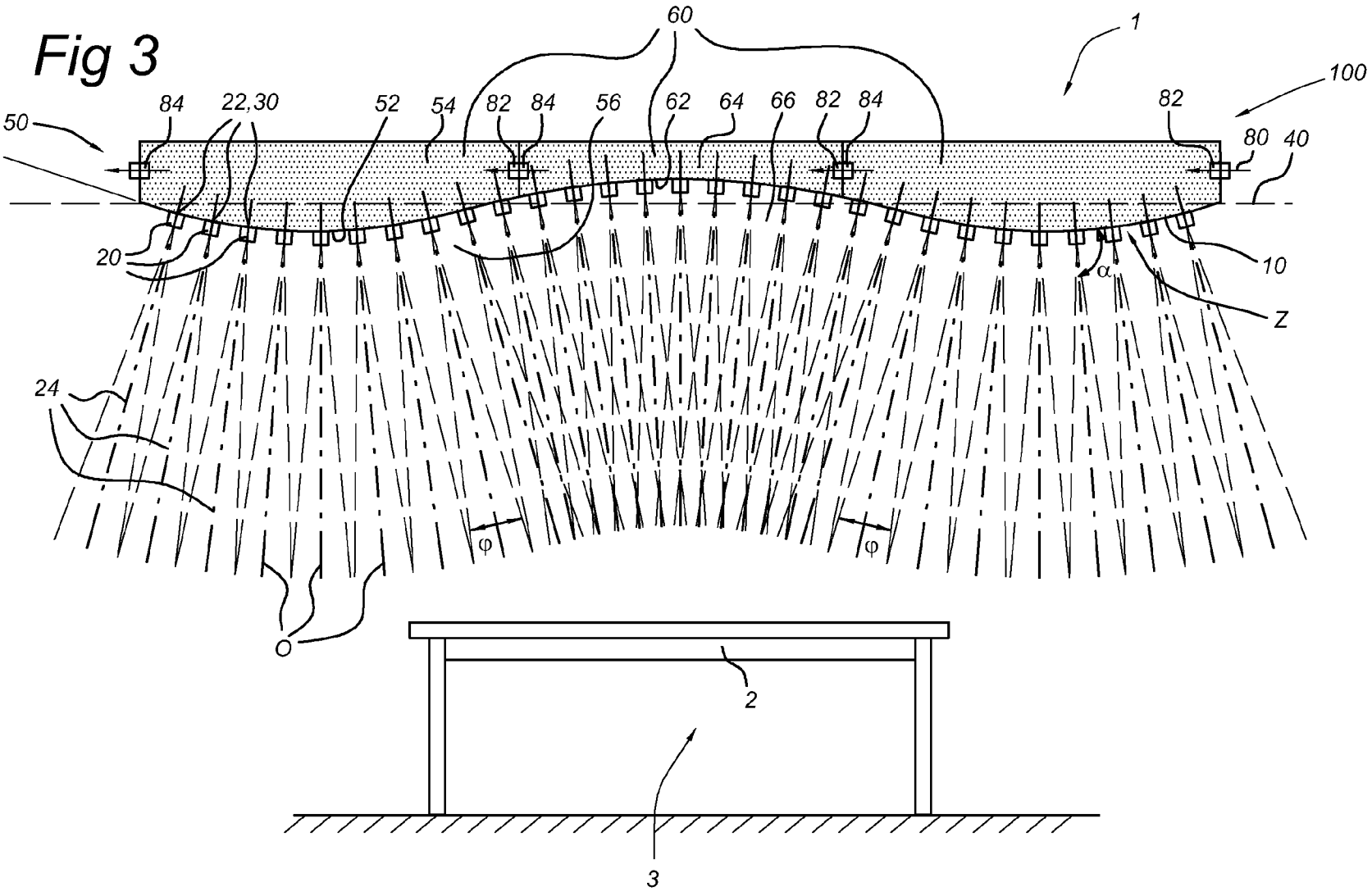
FIG. 3 schematically depicts a further embodiment of a lighting unit according to the invention.

FIG. 3 schematically shows an embodiment of the lighting unit 100, with the pliable surface 10 having a profile Z corresponding to a non-flat shape. The lighting unit 100 has a closed body 50 having a pliable body surface 52 forming the pliable surface 10. The pliable body surface 52 may e.g. be a sheet of pliable material of which one surface forms the pliable surface 10. The closed body 50 may e.g. be a closed box comprising a rigid base plate, side walls connected to the base plate, and a top surface formed by a sheet of pliable material clamped between the side walls. The pliable surface 10 may also be referred to as a membrane in the following, without any intention to limit the pliable body surface 52 to specific materials or types. In this example, the closed body 50 has a plurality of closed compartments 60. Each closed compartment has a pliable compartment surface 62. The compartments 60 are substantially seamlessly arranged. The compartment surfaces 62 together form the pliable body surface 52 of the closed body 50. The closed body 50 is arranged to control the profile Z, using pressure of a fluid. In this example, the pressure is applied as an air pressure to the inside 54 of the closed body 50, relative to the air pressure at the outside 56 of the closed body 50 at the other side of the pliable body surface 52. More particularly, the pressure is applied as a plurality of individually controllable pressures applied to each of the closed compartments 60. In this example, the pressures are applied as air pressures to the insides 64 of the closed compartments 60, relative to the air pressure at the outside 66 of the closed compartments 60 at the other side of the pliable body surface 52, or more specifically, the corresponding pliable body compartment surface 62.

Light sources 20 are provided at the pliable surface 10 at surface areas 30. When the pressure within closed compartment 60 is larger than the outside pressure, the body compartment surface 62 will assume a convex shape, and the light beams 24 generated by the light sources 20 corresponding to the body compartment surface 62 are divergent relative to each other, as is shown for the left and right compartments 60 in FIG. 3. When the pressure within closed compartment 60 is smaller than the outside pressure, the body compartment surface 62 will assume a concave shape, and the light beams 24 generated by the light sources 20 corresponding to the body compartment surface 62 are convergent relative to each other, as is shown for the middle compartment 60 in FIG. 3. The change of shape between different levels of convexity or concavity using pressure of a fluid may be referred to in the following as ballooning. Controlling the changing to a more convex shape may be referred to as inflating. Controlling the changing to a more concave shape may be referred to as deflating.

In an example, also referring to FIGS. 1 and 2, each light source 20 is a light emitting diode (LED), with the distance d between light sources 20 being approximately 10 cm, and the light sources 20 being arranged as a square array of 8×8 light sources 20 distributed over the pliable surface 10 of a square lighting unit. With a ceiling height of 280 cm and a desk height of typically 80 cm from the floor to the work surface, this corresponds to the height h being 2 m, measured from the work surface of the desk to the pliable surface 10. Having light sources with a 6 degree opening angle, a concavity is required with a radius of about 350 cm to concentrate the beams of all light sources 20 of a lighting unit 100 on the work surface.

In the example shown, the pressure is provided by air pressure, but it may alternatively be provided by alternative means, such as other gases, or liquids, such as water. In the description below, reference will be made to air, but the skilled person will understand that it equally applies to the alternative means.

The closed body 50, and more specifically its closed compartments 60, have inlets 82 and outlets 84 for air 80. A flow of air 80 is controlled at the inlets 82 and/or outlets 84 to provide the required pressure within each compartment 60. Apart from, or even alternative to, providing a pressure, the flow of air may also function to transport heat away from the light sources 20: such an airflow can be very effective as a cooling means. Alternatively, the closed body 50, or more specifically its closed compartments 60, may not use a continuous flow of external air passing into the inlets 82 and out of the outlets 84, but may only have a continuous flow of air within the closed body and/or each compartment 60 for providing such cooling function.

Figure 4:
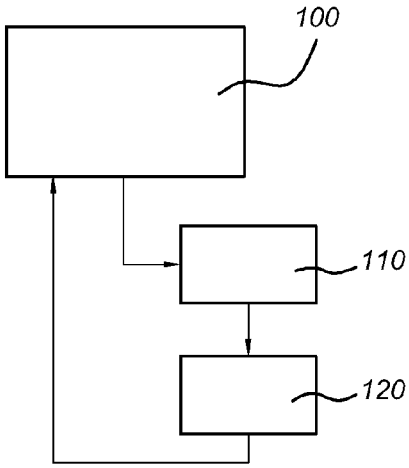
FIGS. 4-8 schematically depict embodiments, and variants thereof, of aspects of a lighting unit and according to the invention.

FIG. 4 shows a further embodiment of a lighting unit 100, further arranged to cooperate with a monitor 110 and a controller 120. The monitor 110 is arranged to monitor a monitor parameter indicating the actual profile Z provided by the pliable body surface 52. The monitor parameter may e.g. be the pressures, gas/air flow and/or a measure of the shape of the pliable body compartment surfaces 62, such as at least one orientation of at least one respective surface area 30 or at least one orientation of at least one respective optical axis O. The monitor 110 is arranged to generate a monitor signal in dependence on the parameter, and provide the monitor signal to the controller 120. The controller 120 is arranged to use the monitor signal for monitoring and controlling the actual profile Z in a control loop, e.g. a feedback control loop. The lighting unit 100 may be equipped with the monitor 110. The monitor 110 may alternatively be provided external to the lighting unit 100 and cooperate with the lighting unit 100. The controller may be comprised in the lighting unit 100. Alternatively, the controller may be provided external to the lighting unit 100 and cooperate with the lighting unit 100.

Figure 5:
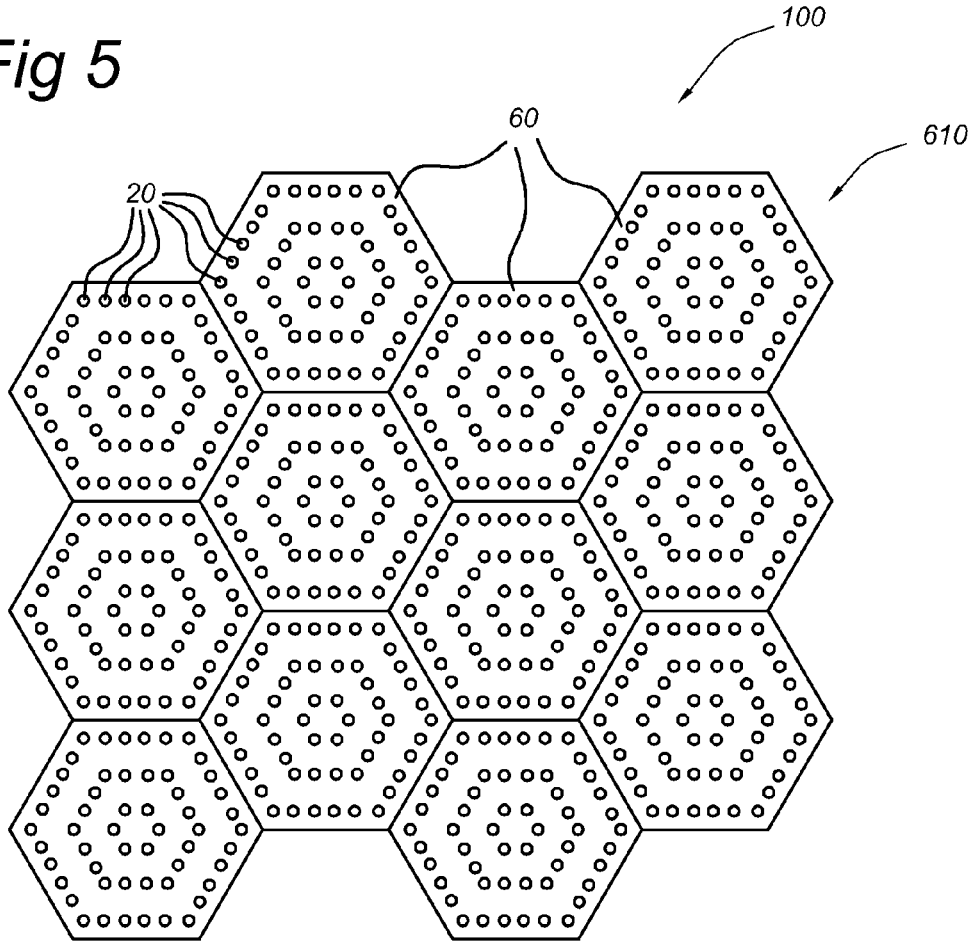

FIG. 5 shows a lighting unit 100 according to an embodiment. In FIG. 5, the lighting unit 100 comprises 12 hexagon-shaped closed compartments 60, each carrying a plurality of light sources 20. In this example, the light sources 20 are light-emitting diodes (LEDs). The lighting unit 100 of FIG. 5 will be further referred to with a specific reference number 610. The lighting unit 610 forms a closed body 50 from the plurality of closed compartments 60. The compartments 60 are substantially seamlessly arranged, thus forming a substantially continuous, pliable surface 10, which can be locally concave or convex by individually providing the compartments 60 with concave or convex compartment surfaces 62.

It will be understood that a lighting unit 100 may alternatively have a single closed body 50, without a division in compartments 60. It will be understood that a lighting system may be composed from a plurality of lighting units 100, and that the lighting system may e.g. have a shape similar to that of the lighting unit 610 of FIG. 5. FIG. 5 may thus also describe a lighting system comprising a plurality of hexagonal lighting units.

Figure 6A:
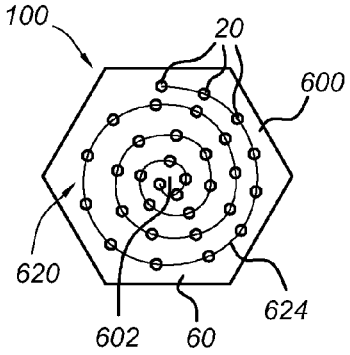
Figure 6B:
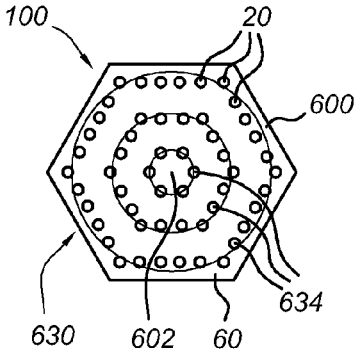
Figure 6C:
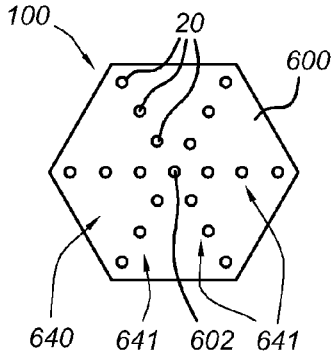

FIGS. 6*a*-6*c* show exemplary embodiments of a lighting unit 100 carrying a plurality of light sources 20. In these exemplary embodiments, the lighting unit 100 has a single compartment 60. The lighting unit 100 is a polygon-shaped, more specifically hexagon-shaped, unit 600. An advantage of the lighting unit 100 being formed in a hexagonal or square shape is that it allows a plurality of lighting units 100 to be arranged together substantially seamlessly.

The light sources 20 may be LEDs.

The number of light sources 20 comprised by one lighting unit 100 may be preferably at least 20, more preferably at least 50, even more preferably at least 100 LEDs. The LEDs are preferably provided at a density of at least 1 LED per 100 $cm^2$, more preferably at a density of at least 1 LED per 50 $cm^2$, even more preferably at a density of at least 1 LED per 20 $cm^2$, still more preferably at a density of at least 1 LED per 10 $cm^2$, and even more preferably at a density of at least 1 LED per 5 $cm^2$, wherein the density is measured relative to the (pliable surface) area of the lighting system.

In the embodiment shown in FIG. 6*a*, the light sources 20 are arranged in a spiraling arrangement 620, centered around a center 602 of the polygon-shaped lighting unit 600. The light sources are electrically connected along the spiraling arrangement by means of a spiraling electrical connection 624. The spiraling arrangement may thus have as a benefit that the electrical connection established along the spiral does not experience high stress when the pliable surface 10 is ballooning.

In the embodiment shown in FIG. 6*b*, the light sources 20 are arranged in a substantially circular arrangement 630, centered around a center 602 of the polygon-shaped lighting unit 600. The light sources are electrically connected along the substantially circular arrangement in substantially concentric circles 634. The circular arrangement may thus have as a benefit that e.g. the electrical connection following the circles does not experience high stress when the pliable surface 10 is ballooning.

In the embodiment shown in FIG. 6*c*, the plurality of light sources 20 is connected to the pliable surface of the polygon-shaped lighting unit 600 in a substantially star-shaped arrangement 640, centered around the center 602 of the polygon-shaped lighting unit 600. The electrical connection of the light sources extends substantially radially, along the legs 641 of the star-shaped arrangement. The star-shaped arrangement may thus have as a benefit that the electrical connection along the legs 641 does not experience high stress when the pliable surface 10 is ballooning.

FIGS. 7*a*-7*d* show alternative embodiments of light sources 20, here light emitting diodes, connected to the pliable surface 10, formed from a sheet 12 of pliable material. Each LED 20 has a light emitting diode package 70, comprising a light emitting diode chip 71 on a small, e.g. ceramic, substrate 75, provided with a primary lens 73 on the light emitting diode chip 71. Such a primary lens 73 is generally used for optimal out-coupling of light generated by the light emitting diode chip 71. The small substrate 75 comprises conductive tracks which electrically connect the light emitting diode chip to conductors 74, arranged to power the LED 20. The LED 20 is further provided with secondary optics 72, which is typically a collimating lens, for shaping the light emitted through the primary lens 73 into a beam with a required opening angle cp.

Figure 7A:
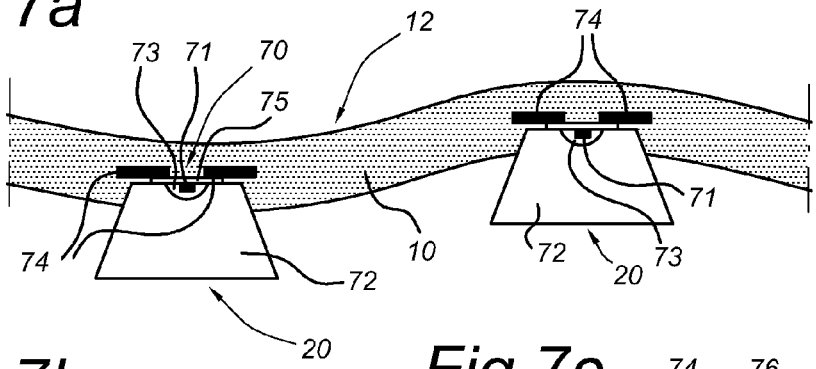

In FIG. 7*a*, the conductors 74 are embedded in the sheet 12, thus connecting the LED 20 to the pliable surface 10. Alternatively, the conductors 74 may be fixed on one of the sides of the sheet 12. The secondary optics 72 thus extends outside of the sheet 12.

Figure 7B:
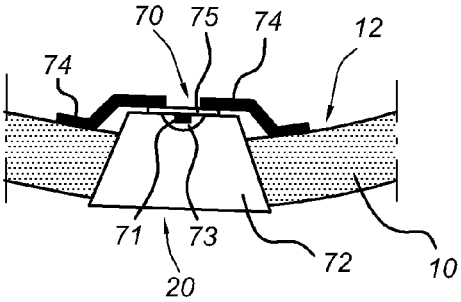
Figure 7C:
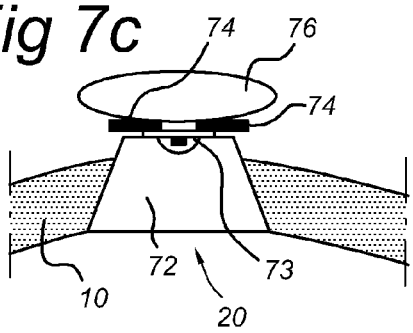

In FIG. 7*b* and FIG. 7*c*, the secondary optics 72 is embedded in the sheet 12 and hence the LED 20 is behind the sheet 12 (as seen from the side where the light beam is delivered). In a preferred embodiment, the secondary optics 72 is directly integrated with the sheet 12 and connects the LED 20 to the sheet 12. The sheet 12 could e.g. be manufactured from an optically suitable silicone. In FIG. 7*c*, an embodiment is shown in detail, wherein the conductors 74 are placed on a separate carrier 76. This separate carrier 76 could be made from a pipe that is used for cooling the light emitting diode chip 70, like a heat pipe. Cooling could be by a forced liquid or air flow.

Figure 7D:
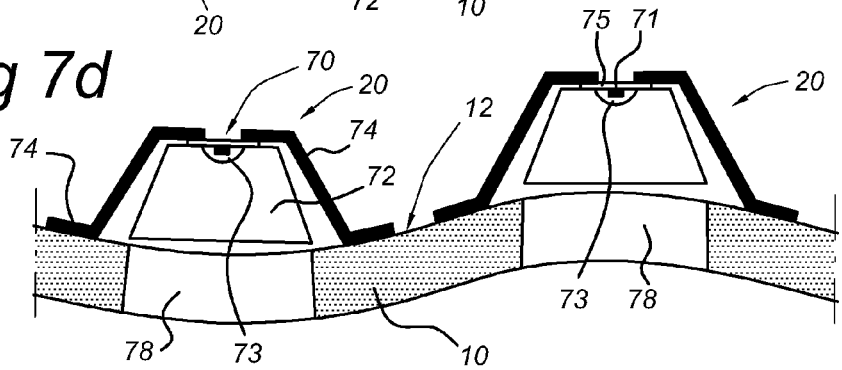

FIG. 7*d* shows an embodiment wherein the LEDs 20 are mounted behind the sheet 12, and connected to the sheet 12 via the conductors 74. The pliable material of the sheet 12 could e.g. be diffusive and colored and have transparent parts 78, e.g. holes or clear windows, through which the collimated light can be delivered. The rest of the membrane might get diffusely lit.

It will be appreciated that the LEDs 20 can also be connected to the pliable surface 10 in alternative manners.

FIGS. 1-3, and FIGS. 7*a*-7*c* show schematically that the pliable surface 10 is substantially continuous. No sharp discontinuities and openings may be perceived, except for embodiments with optional openings to allow light from the light sources to escape from the lighting unit (such as schematically shown in FIGS. 7*b*, 7*c* and 7*d*), and except for the light sources and optional optics (such as schematically shown in FIGS. 1-3, 7*a* and 7*b*).

Figure 8A:
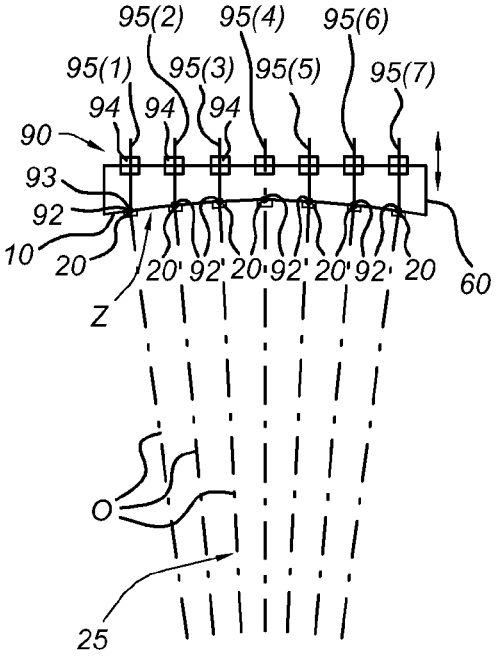
Figure 8B:
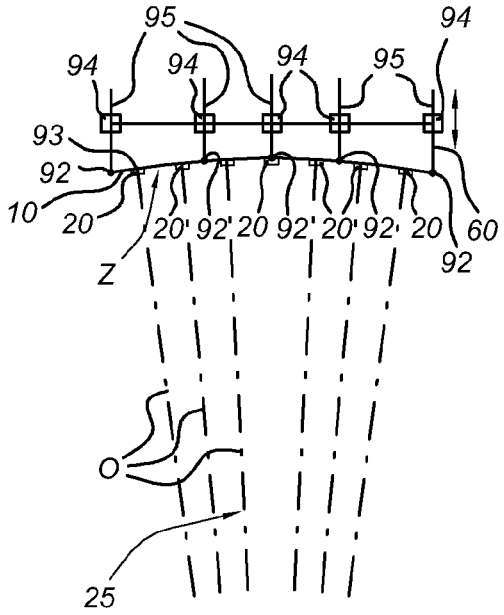
Figure 8C:
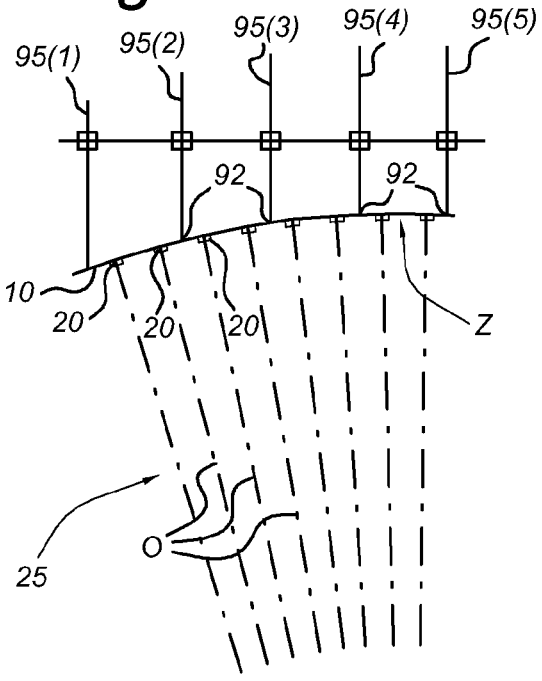

FIGS. 8*a*-8*c* show exemplary embodiments of a lighting unit 100 according to the invention, wherein the lighting unit 100 has an actuator 90 arranged to actuate the pliable surface 10 at a plurality of actuating positions 92. The actuator 90 comprises a plurality of actuator units 94 with respective actuating elements 95 engaging with the pliable surface 10 at the plurality of actuating positions 92. The actuating elements are individually referenced as 95(1), 95(2), . . . . The actuator units 94 are arranged to actuate the actuating elements 95 to position the pliable surface 10 along an axis 96 substantially perpendicular to the reference surface 40 (neither shown in FIG. 8*a* nor in FIG. 8*b*). The actuating elements 95 are e.g. threaded rod-shaped elements which are linearly movable by a respective actuator unit 94 comprising a motor acting on the thread forming a worm bearing. Alternative actuating elements 95 may also be used, e.g. with alternative linear motors e.g. piezomotors. In the situations as shown in FIG. 8*a* and FIG. 8*b*, the actuator 90 has given the pliable surface 10 a concave shape.

The optical axes O of the light beams 24 generated by the optical sources 20 are shown in FIG. 8*a*-FIG. 8*c*. FIG. 8*a*-FIG. 8*c* also show a composed beam 25, being the collection of all light beams provided by the lighting unit 100. In these examples, the pliable surface 10 has a profile Z of concave shape, resulting in a collimated composed beam 25.

FIG. 8*a* shows an embodiment wherein the actuating elements 95 engage with the pliable surface 10 at the positions of the light sources 20. In the example shown, the actuating elements 95 directly engage with the pliable surface 10 (i.e., when formed from a sheet of pliable material, the side of the sheet of pliable material facing the actuating elements 95). In an alternative embodiment, the actuating elements 95 connect directly to the light sources 20, and act on the pliable surface 10 via the light sources 20. In the situation as shown in FIG. 8*a*, the actuator 90 has given the pliable surface 10 a concave shape by moving the respective actuating elements 95 at different positions along the respective axes 96. In particular, the actuating element 95 in the middle of the lighting unit 100, indicated with reference number 95(4), acts on the pliable surface 10 by pulling it towards the actuator units to a first extent, and the actuating elements 95 situated at equal distances from the middle act(?) on the pliable surface 10 by pulling it towards the actuator units to a smaller extent, e.g. actuating elements 95(1) and 95(7) pull the pliable surface 10 to a substantially equal second extent, smaller than the first extent of actuating element 95(4). This has the effect that a concave, symmetric, shape of the pliable surface 10 is achieved. When the actuating elements 95 are driven non-symmetrically, also non-symmetric profiles of the pliable surface 10 can be provided.

FIG. 8*b* shows an alternative embodiment, which differs from the embodiment shown in FIG. 8*a* in that at least some of the actuating elements 95 engage with the pliable surface 10 at positions which are different from positions of the light sources 20. This allows using fewer actuating elements 95 and actuator units 94 than the number of light sources 20, which may be more economical. When a sufficiently large number of actuating elements 95 is used, this still allows shaping the pliable surface 10 in a sufficiently smooth manner.

FIG. 8*c* shows another alternative embodiment of FIG. 8, which differs from the embodiment shown in FIG. 8*b* in that the actuating elements 95(1), . . . 95(5) are driven non-symmetrically, such that a profile Z with an asymmetric shape of the pliable surface 10 is provided. This does not only change the degree of collimation of the composed beam 25 formed by all light beams generated by the optical sources 20, but also changes the direction of the composed beam, whereas symmetric driving of the actuating elements 95(1), . . . 95(5) does not change the direction of the composed beam 25. The lighting unit thus offers additional freedom in providing illumination profiles, by combining the degree of collimation as well as the direction of the composed beam of the lighting unit.

Figure 9:
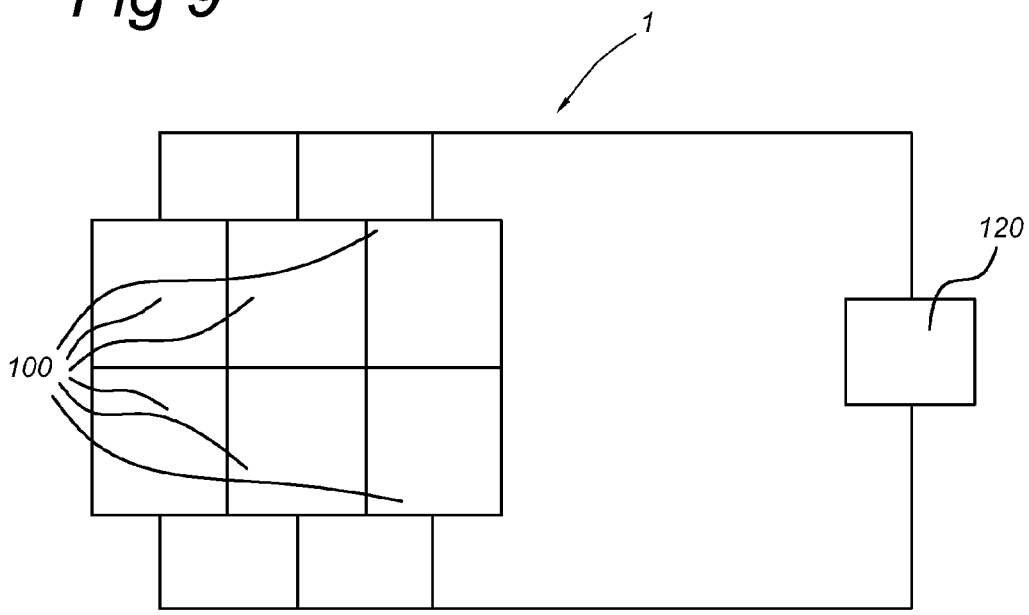
FIG. 9 schematically depicts an embodiment of a lighting unit according to the invention.

FIG. 9 shows a lighting system 1 according to the invention. The lighting system 1 comprises a plurality of lighting units 100. In the example shown, the lighting units 100 are adjacent to one another and interconnected substantially seamlessly, but it will be appreciated that some or more of the lighting units 100 may also be spaced apart from the other lighting units. In the exemplary lighting system 1, the lighting units 100 are all connected to a system controller 120. The system controller 120 is arranged to control the lighting units 100. The controlling process comprises shaping the respective profiles Z, e.g. setting the respective profiles Z of the lighting units 100 to one or more pre-selected profiles, or changing the respective profiles Z from a plurality of first profiles to a plurality of second profiles, of which, for at least one lighting unit, the second shape is different from the first shape.

Figure 10:
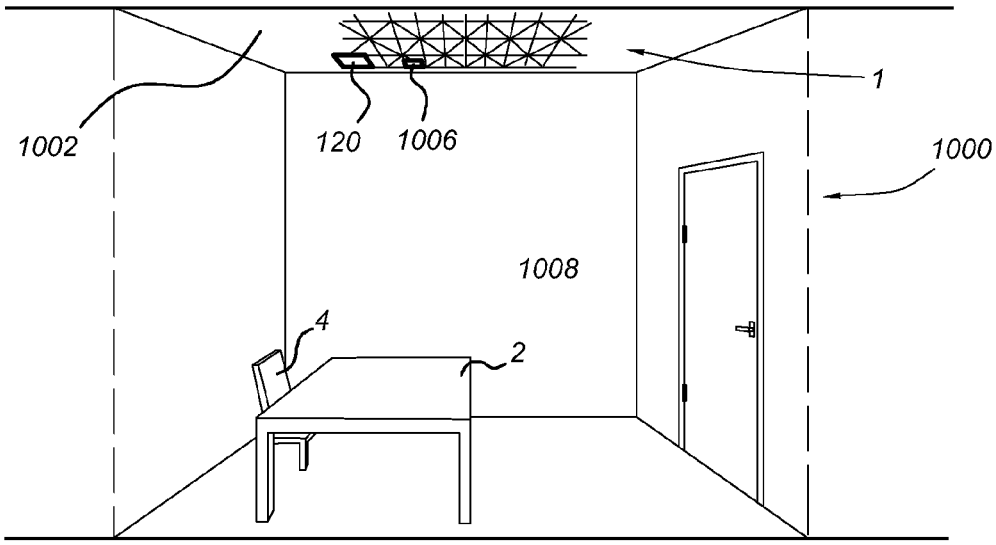
FIG. 10 schematically depicts an embodiment of a space according to the invention.

FIG. 10 shows a space 1000 comprising a lighting system 1 according to the invention. The space 1000 is e.g. (a part of) a closed space, such as an office space, which may e.g. be entered through a door 1008. The lighting system 1 is attached to a ceiling 1002 of the space. A table 2 and chair 4 are positioned in the space 100. The positions of the table 2 and the chair 4 may be changed. Also, the number of tables and chairs may be changed, e.g. to accommodate visitors when the space is a living room or to accommodate additional work spaces when the space is an office space.

The lighting system 1 may further be connected to a system controller 110, which may be arranged external to the lighting system 1, e.g. on the ceiling 1002 itself, but which may also be integrated in the lighting system 1, as was described with reference to FIG. 9. The system controller 120 is especially arranged to control the lighting system 1, and more particularly the individual light sources on different lighting units of the lighting system, or even the individual light sources on the lighting units 100 of the lighting system 1. One or more of color, pattern shape, on/off state, and output intensity of the lighting system 1 may be variable and may be controlled by the controller.

Further, one or more of color and pattern shape of the illumination profile generated by the lighting system 1 may be dependent on a sensor signal of a sensor 1006 (such as an approach sensor, a fire sensor, a smoke sensor, a thermal sensor, etc.), wherein the sensor is arranged to sense an object on or in area that can be illuminated by the lighting system 1 or is arranged to sense a feature selected from the group consisting of smoke and heat, and wherein the system controller 120 is arranged to control one or more of color, on/off state, intensity and pattern shape of the illumination profile generated by the lighting system 1 in dependence on the sensor signal. Therefore, in yet another embodiment, the lighting system 1 further comprises a sensor, such as an approach sensor or a smoke sensor or a thermal sensor, etc., which may be arranged external to the lighting system 1 but which may also be integrated in the lighting system 1. The term sensor may also refer to a plurality of sensors. Such a plurality of sensors may for instance be arranged to sense the same parameter (like a touch of a user) at different locations, or to sense different parameters (like a touch of a user and smoke, respectively).

In the drawings, less relevant features like electrical cables, etc. have not been drawn for the sake of clarity.

The term "substantially" as used herein, such as in "substantially flat" or in "substantially consists", etc., will be understood by the person skilled in the art. In embodiments the adjective substantially may be removed. Where applicable, the term "substantially" may also include embodiments with "entirely", "completely", "all", etc. Where applicable, the term "substantially" may also relate to 90% or higher, such as 95% or higher, especially 99% or higher, including 100%. The term "comprise" includes also embodiments wherein the term "comprises" means "consists of".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in sequences other than those described or illustrated herein.

The devices as used herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The term "and/or" includes any and all combinations of one or more of the associated listed items. The article "a" or "an" preceding an element does not exclude the presence of a plurality of such elements. The article "the" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A lighting unit comprising a closed body having a substantially continuous, pliable surface, the closed body comprises a plurality of individually controllable closed compartments, a hardware controller and a plurality of light sources, wherein:

each of the light sources is arranged to generate a light beam with a respective optical axis, each of the light sources is connected to the pliable surface at a respective surface area of the pliable surface, whereby orientations of the respective surface areas and orientations of the respective optical axes are linked, the pliable surface is configured to assume a plurality of different profiles with corresponding different orientations of at least part of the plurality of surface areas, and the hardware controller is configured to direct the closed body to adjust a shape of the pliable surface and thereby alter illumination characteristics of the lighting unit, wherein the shape of the pliable surface is adjusted by applying a fluid pressure to the plurality of individually controllable closed compartments located inside the closed body.

2. The lighting unit according to claim 1, wherein the closed body comprises an actuator configured to actuate the pliable surface at a plurality of actuating positions.

3. The lighting unit according to claim 1, wherein the closed body comprises an actuator arranged to actuate the optical axes of the light sources at actuating positions at the light sources.

4. The lighting unit according to claim 1, wherein the lighting unit is polygon-shaped.

5. The lighting unit according to claim 1, comprising a pliable electrical connection connecting the plurality of light sources.

6. The lighting unit according to claim 1, wherein the light sources are LEDs, and wherein the LEDs are provided at a density of at least 1 LED per 100 $cm^2$ of pliable surface.

7. A lighting unit according to claim 1, wherein the closed body is polygonal shaped.

8. The lighting unit according to claim 6, wherein the LEDs are provided at a density of at least 1 LED per 10 $cm^2$ of pliable surface.

9. The lighting unit according to claim 1, wherein the pliable surface is elastically or plastically deformable.

10. The lighting unit according to claim 1, wherein the controller is configured to direct the closed body to adjust the shape of the pliable surface to a first shape such that at least a subset of the light sources form a concentration of light at a first area in a space illuminated by the lighting unit.

11. The lighting unit according to claim 10, wherein the controller is configured to direct the closed body to adjust the shape of the pliable surface to the first shape such that at least a second subset of the light sources form a general illumination of light about the concentration in the space.

12. The lighting unit according to claim 10, wherein the controller is configured to direct the closed body to adjust the shape of the pliable surface to a second shape that is different from the first shape such that an other concentration of light is formed at a second area in a space that is different from the first area.

13. The lighting unit according to claim 1, wherein the controller is configured to direct the closed body to adjust the shape of the pliable surface to a first shape such that a plurality of concentrations of light are formed at respective first areas in a space illuminated by the lighting unit.

14. The lighting unit according to claim 13, wherein the controller is configured to direct the closed body to adjust the shape of the pliable surface to the first shape such that a general illumination of light is formed about the plurality of concentrations in the space.

15. The lighting unit according to claim 13, wherein the controller is configured to direct the closed body to adjust the shape of the pliable surface to a second shape that is different from the first shape such that a plurality of other concentrations of light are formed at respective second areas in spaces that are different from the respective first areas.

16. A lighting unit comprising a closed body having a substantially continuous, pliable surface, wherein the closed body comprises a plurality of individually controllable closed compartments, a hardware controller and a plurality of light sources, wherein each of the light sources is connected to the pliable surface at a respective surface area of the pliable surface, whereby orientations of the respective surface areas and orientations of the respective light sources are linked, the pliable surface is configured to assume a plurality of different profiles with corresponding different orientations of at least part of the plurality of surface areas, and the hardware controller is configured to direct the closed body to adjust a shape of the pliable surface to a first shape such that a concentration of light is formed at a first area in a space illuminated by the lighting unit and to direct the closed body to adjust the shape of the pliable surface to second shape such that an other concentration of light is formed at a respective second area in the space that is different from the first area, wherein the closed body is configured to adjust the shape of the pliable surface by applying a fluid pressure to the plurality of individually controllable closed compartments located inside the closed body.

* * * * *